US006354862B1

(12) United States Patent
Matso

(10) Patent No.: US 6,354,862 B1
(45) Date of Patent: Mar. 12, 2002

(54) ELECTRICAL CONNECTOR

(75) Inventor: Tsutomu Matso, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/688,133

(22) Filed: Oct. 16, 2000

(30) Foreign Application Priority Data

Oct. 28, 1999 (JP) ..... 11-306271

(51) Int. Cl.[7] ..... H01R 4/50
(52) U.S. Cl. ..... 439/392; 439/266; 439/259
(58) Field of Search ..... 439/342, 259, 439/260, 261, 262, 263, 264, 265, 266, 267, 268, 269, 270

(56) References Cited

U.S. PATENT DOCUMENTS 3,858,959 A * 1/1975 Arnold ..... 439/263
5,489,218 A * 2/1996 McHugh ..... 439/342
5,611,705 A * 3/1997 Pfaff ..... 439/266
6,206,715 B1 * 3/2001 Liu et al. ..... 439/342

* cited by examiner

*Primary Examiner*—P. Austin Bradley
*Assistant Examiner*—Alexander Gilman
(74) *Attorney, Agent, or Firm*—Kanesaka & Takeuchi

(57) ABSTRACT

The driving mechanism has a bearing hole (33) provided in the second support plate (30) and an elongated hole (22) provided in an intermediate plate (20) so as to extend in a direction perpendicular to the relative movement with respect to the second support plate (30). The driving shaft (40) has a shaft section (42) slidably supported by the bearing hole (33) and a driving section (41) housed in the elongated hole (22). The driving section has a small-diameter portion (43), a large-diameter portion (44) having a constant diameter, and a pair of transitional portions (45A, 45B) between them. The small- and large-diameter portions (43, 44) have a common axis (Z) with the shaft section (42). The minor diameter of the elongated hole (22) is substantially equal to the sum of the radii (r and R) of the small and large diameter portions (43, 44). When the driving shaft (40) is rotated so that the large-diameter portion (44) pushes the minor-diameter side of the elongated hole (22), the contact elements (11, 32) are brought into contact with each other while when the large-diameter portion (44) disengages with the minor-diameter edge, the contact is released.

4 Claims, 5 Drawing Sheets

R-r
r
21
40
R
32
32A
32B
11
R-r
DRIVING TORQUE
ROTARY ANGLE

R-r
54
72
r
R
50
60
70
61
51
d
d
R-r
DRIVING TORQUE
ROTARY ANGLE

ELECTRICAL CONNECTOR

BACKGROUND OF THE INVENTION

1. Field of the Invention

The present invention relates to electrical connectors and, more particularly, to an electrical connector wherein a pair of support plates are relatively moved to bring the male contact elements into contact with the female contact elements.

2. Description of the Related Art

An example of such conventional electrical connectors is disclosed in U.S. Pat. No. 5,707,247.

As shown in FIG. 4, male and female contact elements 51 and 61 are supported at regular intervals by first plate 50, such as an IC package, and second support plate 6O, respectively. Each male contact element 51 has a pin-like form and extending downwardly from the first support plate 50 and passes through an aperture 53 formed in an intermediate plate 52. Each female contact element 61 has narrow and wide sections 61A and 61B, respectively, and placed in a window 62 of the second support plate 60.

The intermediate plate 52 is provided with an elongated hole 54, and the second support plate 60 has a bearing hole 63 in which an eccentric cam or driving shaft 70 is fitted for rotation. The driving shaft 70 has a shaft section 71 supported by the bearing hole 63 for rotation, a driving section 72 situated in the elongated hole 54, and a flange section 73 situated above the driving section 72. The driving section 72 has a generally cylindrical surface which is eccentric relative to the shaft section 71 and has a diameter larger than that of the shaft section 71. The driving section 72 is provided with a flat portion 72A to form a gap (d) between the driving section 72 and the elongated hole 54 in the direction of minor diameter of the elongated hole 54. A groove 73A is provided in the top of the flange section 73 to receive a screwdriver or the like to produce a torque.

In operation, as shown in FIGS. 5(A)–(C), when the driving shaft 70 is turned clockwise by a predetermined angle from FIG. 5(A) to FIG. 5(B) to move both of the intermediate and first support plates 52 and 50 relative to the second support plate 60 by a difference (R—r), wherein the R and r are the largest and smallest radii, respectively, of the driving section 72 from the axis of the shaft section 71, pushing the male contact elements 51 into the narrow sections 61A of the female contact elements 61 under contact pressures, thus providing connection between the contact elements.

When the driving section 72 is moved from FIG. (B) to FIG. (C), the flat portion 72A is opposed to a major wall of the elongated hole 54, forming the gap (d). Consequently, the necessary torque for rotation abruptly becomes zero at the connection position as shown in FIG. 5(C), providing the operator with a sense of a click indicating the connection. The gap (d), however, forms a play and changes the contact pressure under the influence of an impact or vibration. As a result, not only the contact resistance of contact elements becomes unstable, but also the position of the eccentric cam is difficult to control.

SUMMARY OF THE INVENTION

Accordingly, it is an object of the invention to provide an electrical connector capable of not only providing a sense of click upon connection of the contact elements but also making the connection kept stable.

According to the invention there is provided an electrical connector for connecting a first support plate having at least one male contact element, a second support plate having at least one female contact element, and a drive mechanism for moving the first support plate relative to the second support plate in a first direction between a lock position where the male contact element is brought into contact with the female contact element and a release position where the male contact element is disengaged from the female contact element.

The drive mechanism comprises a bearing hole provided in either of the intermediate or first plate and the second support plate; an elongated hole provided in the other member and extending in a second direction perpendicular to the first direction; and a driving shaft having a shaft section in sliding relation to the bearing hole and a driving section provided in the elongated hole and having a small-diameter portion, a large-diameter portion, and a pair of transitional portions between them. The elongated hole has a minor diameter substantially equal to a sum of radii of the small- and large diameter portions and a major diameter greater than the minor diameter so that when the driving shaft is rotated, the large-diameter or transitional portion engages a major side of the elongated hole to bring the first plate to the lock position or disengages the major side to bring the first plate to the release position.

The spring contact between the contact elements may be made by the large-diameter portion pushing the minor diameter side of the elongated hole. Since the large-diameter portion has a constant radius, there is no play produced and a sense of click is generated when the pushing point moves from the transitional portion to the large-diameter portion. However, a small torque is generated by the reactive force due to the spring contact between the contact elements, making the position stable. The large-diameter and transitional portions may have bottom faces in sliding relation to the second support plate so that rotation of the driving shaft is made smooth. The bottom faces and the second support may be provided with stoppers to prevent the driving shaft from being rotated beyond the connection position. The first support plate may be part of an integrated circuit package.

DESCRIPTION OF THE PREFERRED EMBODIMENTS

Embodiments of the invention will now be described with reference to FIGS. 1–3.

Figure 1:
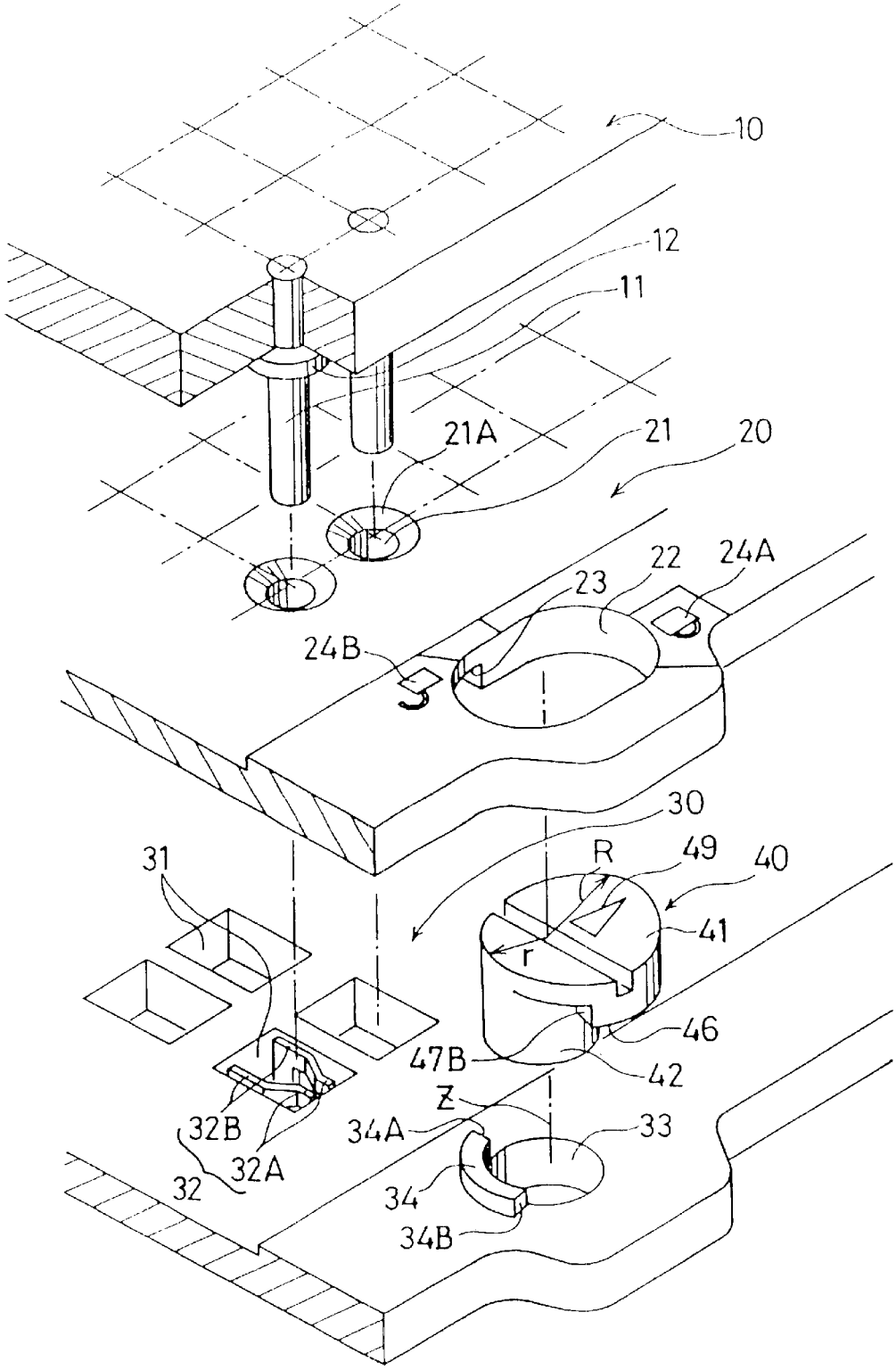
FIG. 1 is an exploded perspective view of an electrical connector according to an embodiment of the invention.
Figure 2:
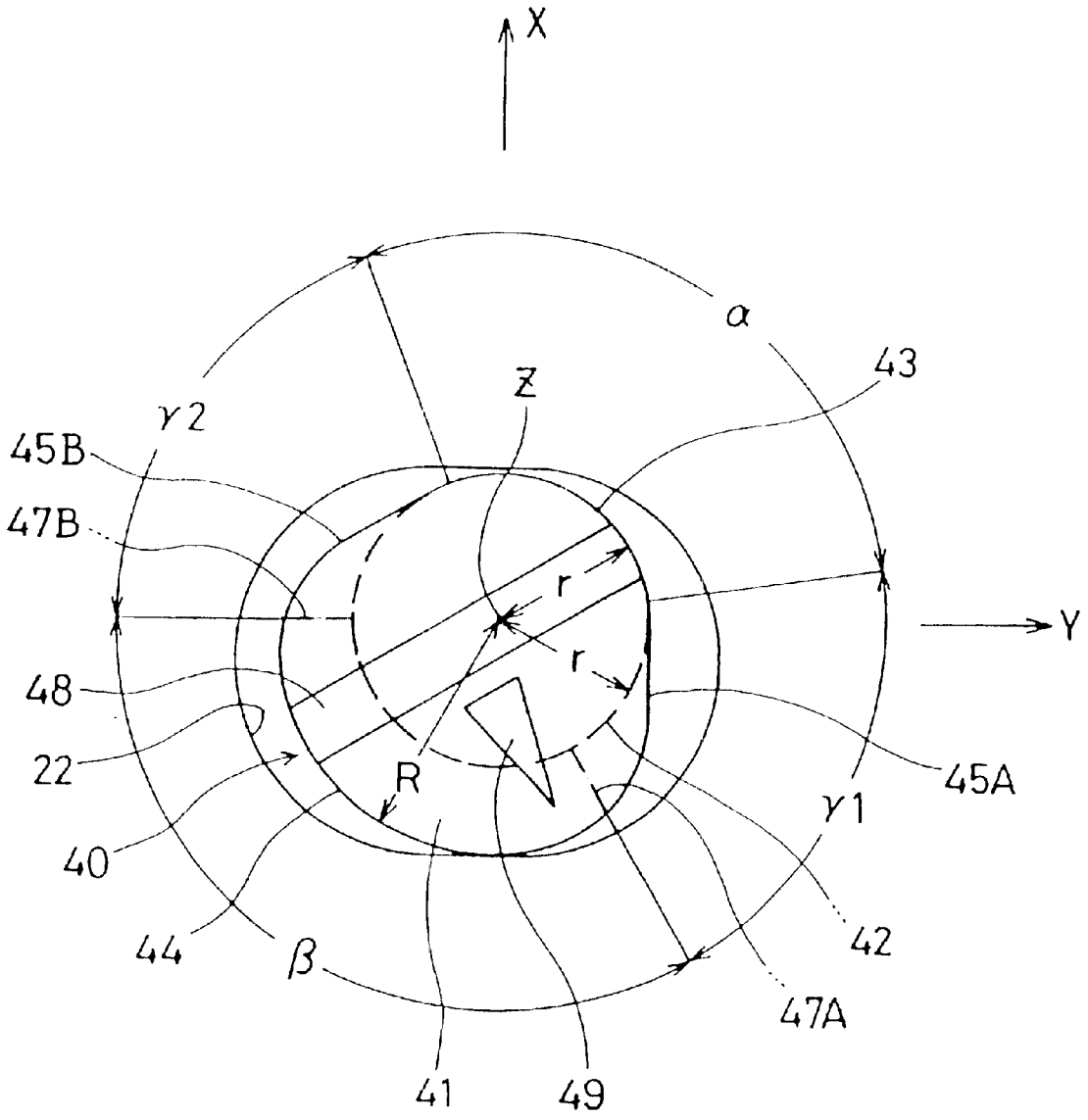
FIG. 2 is a top plan view of a driving mechanism for the electrical connector.

In FIG. 1, a plurality of male contact elements 11 are supported at regular intervals by a first support plate 10 such as an IC package. Each male contact element 11 has the form of a pin which has a flange section 12 at the midpoint. It is fitted into the first support plate 10 such that the flange section 12 abuts against the lower surface of the first support plate 10.

Also, the male contact elements 11 are guided by an intermediate plate 20, which is made of an insulative material and has a plurality of apertures 21 formed at positions corresponding to the respective male contact elements 11. Each aperture 21 has a tapered edge 21A to facilitate insertion of the male contact element 11. An elongated hole 22 is provided in the intermediate plate 20 as described hereinafter.

A second support plate 30 is made of an insulative material so as to provide a plurality of windows 31 in which female contact elements 32 are supported. Like the apertures 21 of the intermediate plate 20, the windows 31 are formed at positions corresponding to the respective male contact elements 11. Each female contact 32 has a pair of walls forming a wide portion 32B and a narrow portion 32A which holds a male contact element 11 between the walls. A bearing hole 33 is provided in the second support plate 30 as described hereinafter.

A driving shaft 40 engages with the elongated hole 22 and the bearing hole 33 of the intermediate and second support plates 20 and 30, respectively, as described below in detail. The driving shaft 40 has a driving section 41 at the upper portion and a shaft section 42 at the lower portion. The shaft section 42 has a cylindrical surface which has an axis aligned with the center line Z of the bearing hole 33 and a radius r so as to be in sliding relation to the bearing hole 33. As best shown in FIG. 2, the driving section 41 has a small-diameter portion 43, a large-diameter portion 44, and a pair of curved portions 45A and 45B to connect them smoothly. The small-diameter portion 43 has a radius r in the range of an angle $\alpha$, the large-diameter portion 44 has a radius R, which is larger than r, in the range of an angle $\beta$. Consequently, the difference (R—r) is equal to the relative movement required for the first and second support plates 10 and 30. That is, when the first support plate 10 is moved from the second support plate 30 by the distance (R—r), the male contact elements 11 are pushed into the narrow portions 32A of the female contact elements 32 for making contact under a predetermined pressure. The small- and large-diameter portions 45A and 45B are connected with the curved transitional portions 45A and 45B in the ranges of angles $\gamma$1 and $\gamma$2, respectively.

The large-diameter portion 44 and the transitional portions 45A and 45B are thicker than the shaft section 42 and project radially in the form of a flange, forming a sliding surface 46 in sliding relation to othe upper face of the second support plate 30. A pair of stopper faces 47A and 47B are provided between the large-diameter portion 44 and the transitional portions 45A and 45B, respectively. A groove 48 is provided in the top of the driving section 41 for engagement with a screwdriver or the like to provide the driving shaft 40 with a torque. A position mark 49 is provided on the top of the driving shaft to allow determination, by observation, of the rotary position of the driving shaft 40.

An arc-shaped stopper 34 is provided on the second support plate 30 such that the stopper faces 34A and 34B abut against the stopper faces 47A and 47B to keep the rotation of the driving shaft 40 within the range of the angle $\beta$ of the large-diameter portion 44.

The elongated hole 22 has a minor diameter in a direction X where the first and second support plates 10 and 30 are relatively moved to provide a predetermined spring pressure to the engagement between the contact elements 11 and 32, and a major diameter in a direction Y which is perpendicular to the direction X. The minor and major diameters are substantially equal to and greater than the sum of the radii r and R, respectively. A notch 23 is provided in the lower face of the intermediate plate 20 such that it does not block relative movement in the directions X and Y between the first and second support plates 10 and 30. Respective lock and release marks 24A and 24B are provided on the intermediate plate 20 around the elongated hole to indicate the lock and release positions of spring engagement between the contact elements 11 and 32. The driving shaft 40 is rotated to bring the position mark 49 to an area indicated by either the lock or release mark 24A or 24B.

How to use the electrical connector will be described below.

(1) The first support plate 10, which supports the male contact elements 11, is placed on the intermediate plate 20 such that the male contact elements 11 are put into the apertures 21. Then, the intermediate plate 20 is joined with the second support plate 30 by means of the driving shaft 40 such that the male contact elements 11 are put in the wide portions 32 of the female contact elements 32 in the second support plate 30 as shown in FIG. 3(A).

(2) The driving shaft 40 is then rotated in the clockwise direction as shown in FIGS. 3(A)–3(D). From FIG. 3(A) to FIG. 3(B), both of the first support plate 10 and the intermediate plate 20 are moved forwardly in the direction X by the transitional portion 45B of the driving shaft 40 and the male contact elements 11 are moved from the wide portions 32B to the mouths of the narrow portions 32A of the female contact elements 32. Accordingly, the torque due to the reactive force upon the driving shaft 40 is zero during this period. From FIG. 3(B) to FIG. 3(C), the intermediate plate 20 is further moved forwardly by the transitional portion 45B of the driving shaft 40 so that the male contact elements 11 enter and expand the narrow portions 32A of the female contact elements 32, increasing the reactive torque. At FIG. 3(D), the first support plate 10 and the intermediate plates 20 reach the maximum advance position, where the large-diameter portion 44 starts to contact with the minor edge of the elongated hole 22 and the male contact elements 11 are fully put in the narrow portions 32A of the female contact elements 32 so that both of the contact elements 11 and 32 are brought into contact with each other under a predetermined spring pressure.

(3) Since the large-diameter portion 44 has a constant radius, the driving shaft 40 does not further advance the intermediate plate 20. Consequently, the torque rapidly decreases, providing the operator with a sense of click, indicating the connection of the contact elements. However, the narrow portions 32A of the female contact elements 32 pinch the male contact elements 11, producing a small reactive force which, in turn, produces a small torque to assure the stable condition.

Figures 3A, 3B, 3C, 3D, 3E:
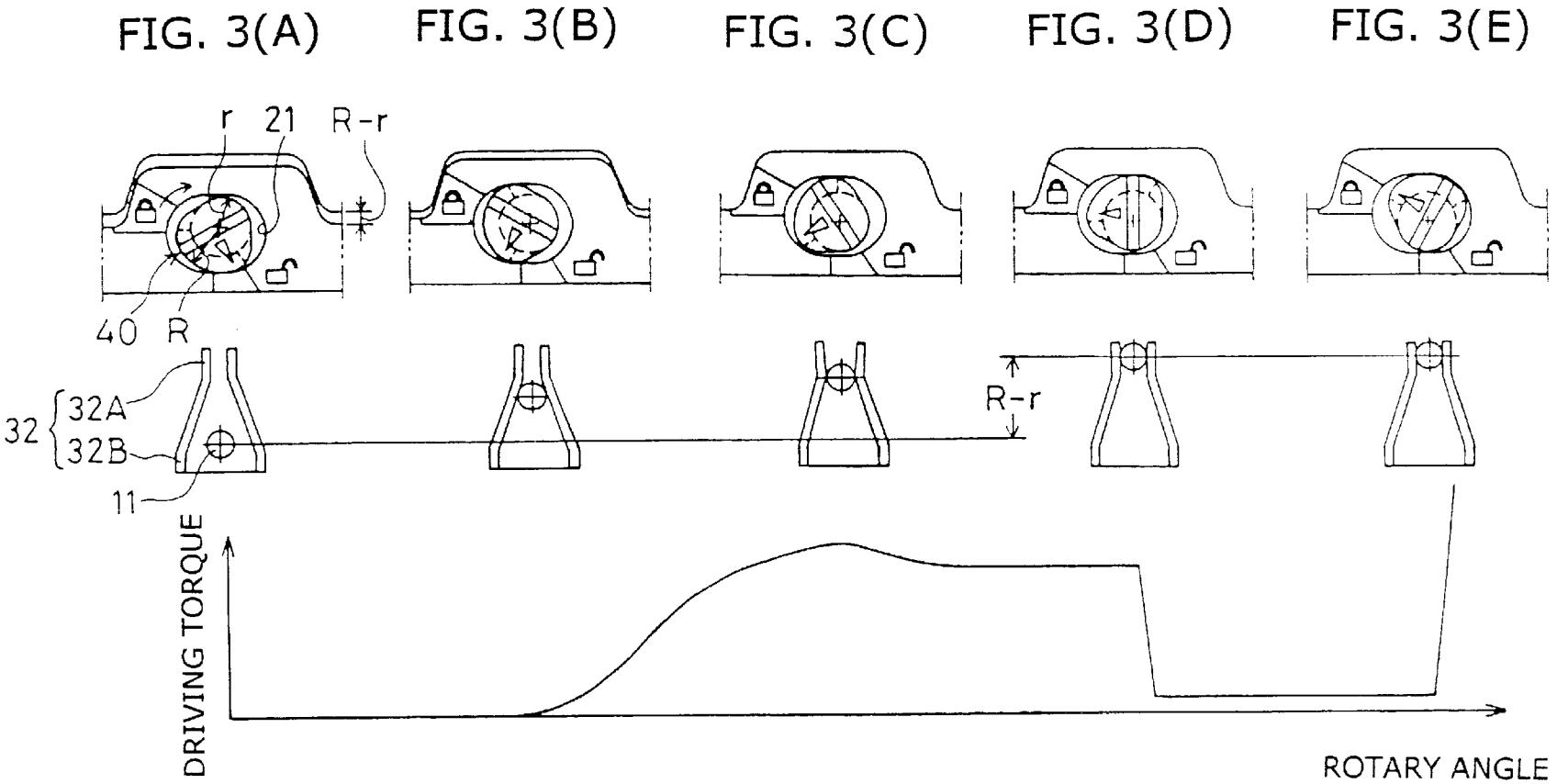
FIGS. 3(A)–(E) are top plan views of the driving mechanism in various stages.
Figure 4:
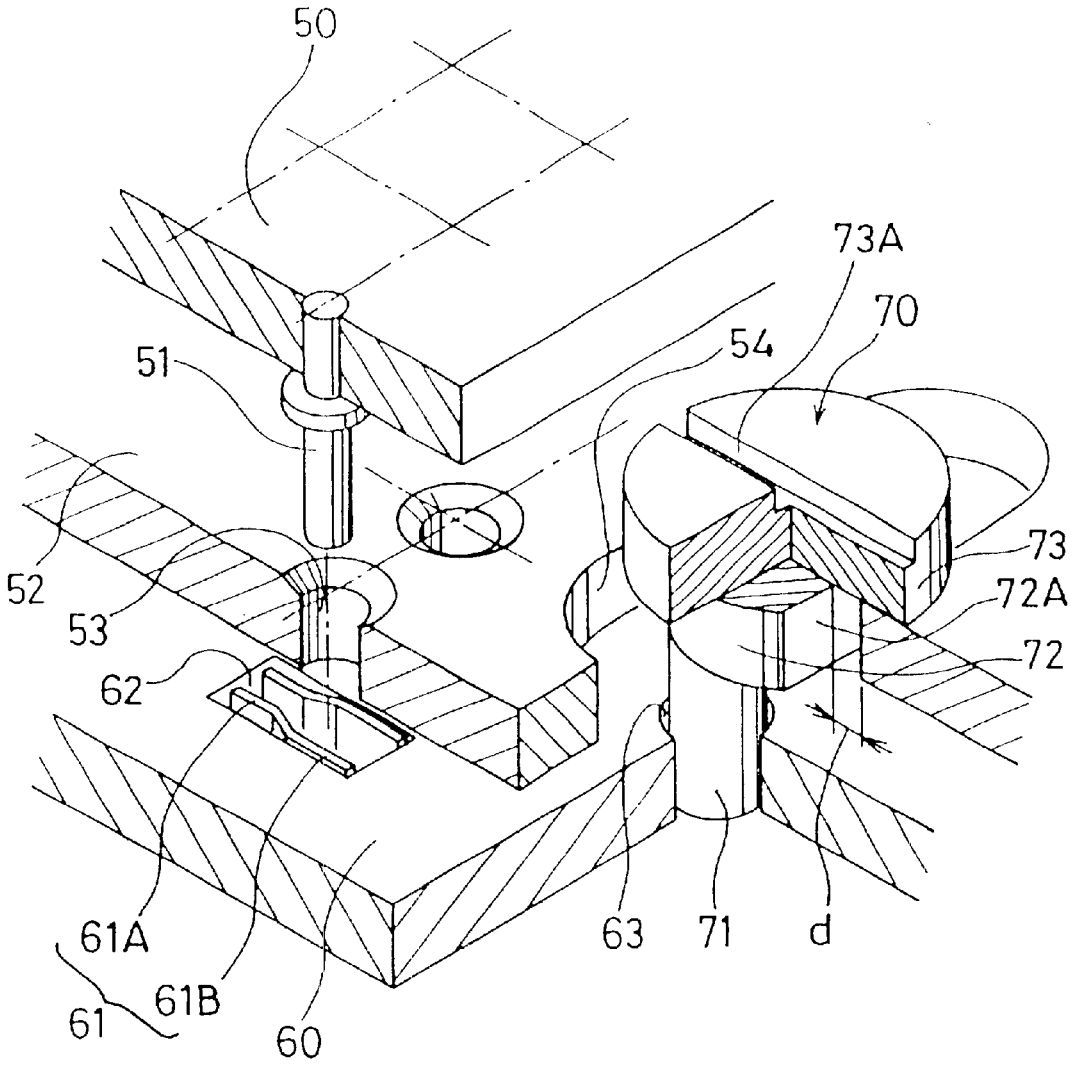
FIG. 4 PRIOR ART
FIG. 4 is an exploded perspective view of a conventional electrical connector.
Figures 5A, 5B, 5C:
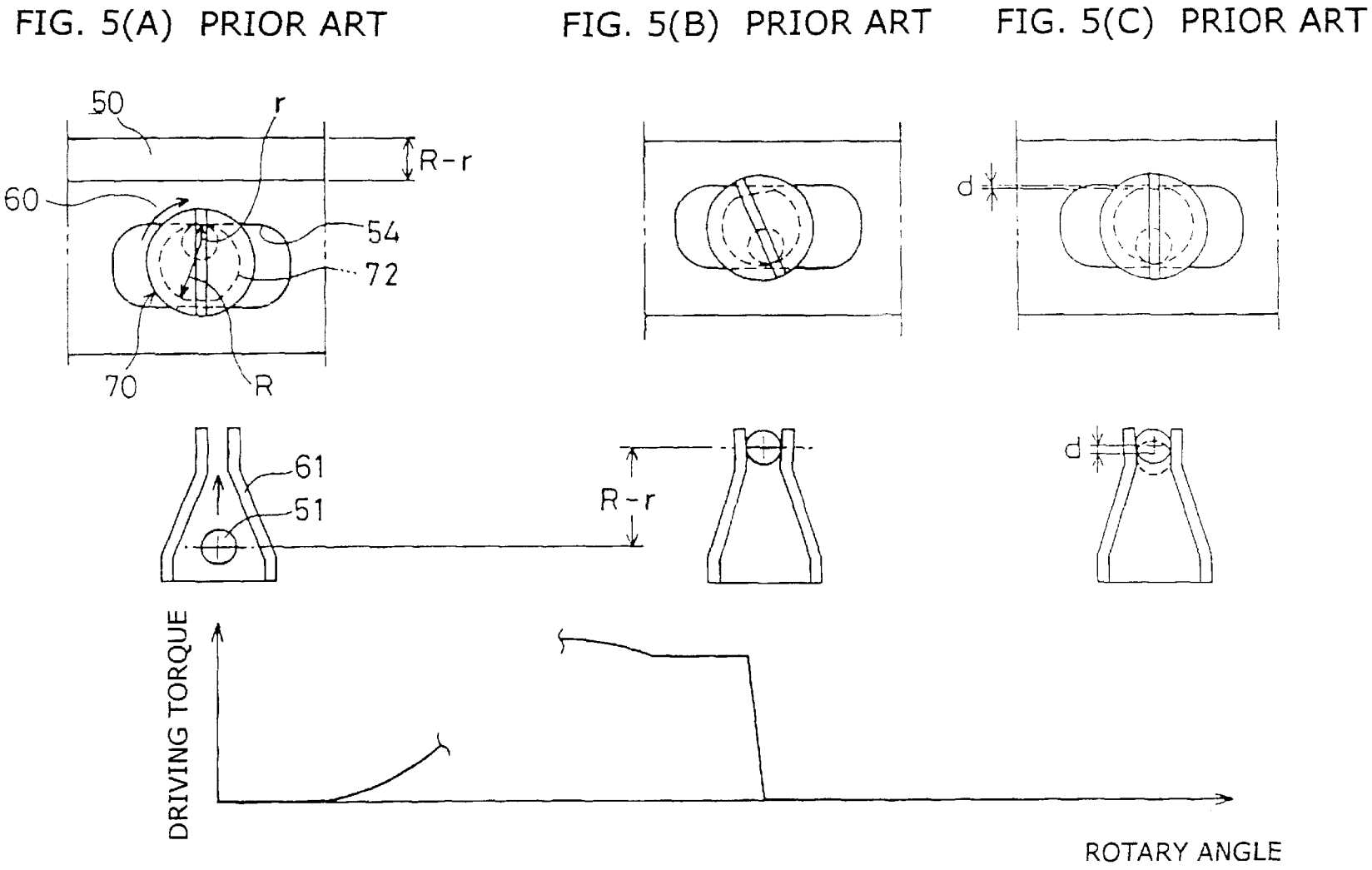
FIG. 5(A) PRIOR ART
FIG. 5(B) PRIOR ART
FIG. 5(C) PRIOR ART
FIGS. 5(A)–(C) are top plan views of the driving mechanism for the conventional electrical connector in various stages.

(4) At FIG. 3(E), the stopper faces 47B and 34B abut on each other, producing a sharp large reactive torque to stop further rotation of the driving shaft 40.

(5) In order to release the connection of the contact elements 11 and 32, the driving shaft 40 is rotated in the counterclockwise direction from FIG. 3(E) to FIG. 3(A).

The invention is not limited to the above illustrated embodiment. For example, if the stopper is removed, the rotation of the driving shaft in either direction can alternate connection and release operation of the contact elements. The first support plate and the intermediate plate may be formed as a unit member.

As has been described above, the radius of the large-diameter portion of the driving shaft is constant so that not only no play is produced under the connection condition but also a certain friction is kept by the spring pressures on the contact elements. Consequently, the rotational position of the driving shaft is made stable, making the contact resistance stable and the electrical characteristics improved. With the stopper installed, even if an excessive torque is applied to the driving shaft, the driving shaft does not pass the connection position.

What is claimed is:

1. An electrical connector for connecting a first support plate having at least one male contact element and a second support plate having at least one female contact element and movable in a first direction relative to said second support plate between a lock position where said male contact element is brought into contact with said female contact element and a release position where said male contact element is disengaged from said female contact element, comprising:

an intermediate plate provided between said first and second support plates and has at least one aperture through which said male contact element passes;

a bearing hole provided in either said intermediate plate or said second support plate;

an elongated hole provided in the other of said intermediate plate and said second support plate and extending in a second direction perpendicular to said first direction;

a driving shaft having a shaft section in sliding relation to said bearing hole and a driving section situated in said elongated hole and having a small-diameter portion, a large-diameter portion having a constant diameter, and a pair of transitional portion between them to smoothly connect said small- and large-diameter portions;

said elongated hole having a minor diameter substantially equal to a sum of radii of said small- and large-diameter portions and a major diameter greater than said minor diameter so that when said driving shaft is rotated, said large-diameter or transitional portion engages a major side of said elongated hole to bring said first plate to said lock position or disengages said major side to bring said first plate to said release position.

2. An electrical connector according to claim 1, wherein said large-diameter and transitional portions have bottom faces in sliding relation to said second support plate.

3. An electrical connector according to claim 2, wherein said bottom faces and said second support are provided with stoppers to prevent said driving shaft from being rotated beyond said lock position.

4. An electrical connector according to claim 1, wherein said first support plate is a part of an integrated circuit package.

* * * * *

UNITED STATES PATENT AND TRADEMARK OFFICE

CERTIFICATE OF CORRECTION

PATENT NO. : 6,354,862 B1
DATED : March 12, 2002
INVENTOR(S) : Tsutomu Matsuo

It is certified that error appears in the above-identified patent and that said Letters Patent is hereby corrected as shown below:

Column 5, line 7 through Column 6, line 12,
Cancel beginning with "1. An electrical connector for connecting" to and including "to said release position", and insert the following:

1. An electrical connector for connecting a first support plate having at least one male contact element and a second support plate having at least one female contact element and movable in a first direction relative to said first support plate between a lock position where said male contact element is brought into contact with said female contact element and a release position where said male contact element is disengaged from said female contact element, comprising:

an intermediate plate provided between said first and second support plates and has at least one aperture through which said male contact element passes;

a bearing hole provided in either said intermediate plate or said second support plate;

an elongated hole provided in the other of said intermediate plate and said second support plate and extending in a second direction perpendicular to said first direction; a driving shaft having a shaft section in sliding relation to said bearing hole and driving section situated in said elongated portion having a constant diameter, and a pair of transitional portion between them to smoothly connect said small- and large-diameter portions;

said elongated hole having a minor diameter substantially equal to a sum of radii of said small- and large-diameter portions and a major diameter greater than said minor diameter so that when said driving shaft is rotated, said large-diameter or transitional portion engages a major side of said elongated hole to bring said first plate to said lock position or disengages said major side to bring said first plate to said release position.

Signed and Sealed this

Ninth Day of May, 2006

JON W. DUDAS
*Director of the United States Patent and Trademark Office*

UNITED STATES PATENT AND TRADEMARK OFFICE

CERTIFICATE OF CORRECTION

PATENT NO. : 6,354,862 B1
APPLICATION NO. : 09/231973
DATED : March 12, 2002
INVENTOR(S) : Tsutomu Matsuo It is certified that error appears in the above-identified patent and that said Letters Patent is hereby corrected as shown below:

Column 6, line 3, "a pair of transitional portion" should read -- a pair of transitional portions --.

Signed and Sealed this

Twenty-ninth Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 6,354,862 B1
APPLICATION NO. : 09/688133
DATED : March 12, 2002
INVENTOR(S) : Tsutomu Matsuo It is certified that error appears in the above-identified patent and that said Letters Patent is hereby corrected as shown below:

Column 6, line 3, "a pair of transitional portion" should read -- a pair of transitional portions --.

This certificate supersedes Certificate of Correction issued August 29, 2006.

Signed and Sealed this

Twenty-eighth Day of November, 2006

JON W. DUDAS
*Director of the United States Patent and Trademark Office*